United States Patent [19]

Viesturs et al.

[11] 4,422,194

[45] Dec. 27, 1983

[54] FLUID FILLED BODY SUPPORTING DEVICE

[75] Inventors: Gundar E. Viesturs; Eric A. Viesturs, both of Southbury, Conn.

[73] Assignee: Connecticut Artcraft Corp., Naugatuck, Conn.

[21] Appl. No.: 295,504

[22] Filed: Aug. 24, 1981

[51] Int. Cl.[3] ..... A47C 27/08; A61G 7/04

[52] U.S. Cl. ..... 5/451; 5/441; 5/455

[58] Field of Search ..... 5/449–452, 5/441, 455, 456

[56] References Cited

U.S. PATENT DOCUMENTS

| | | | |
|---|---|---|---|
| 3,958,286 | 5/1976 | Rodinsky | 5/451 |
| 4,247,963 | 2/1981 | Reddi | 5/441 |
| 4,370,769 | 2/1983 | Herzig et al. | 5/451 |

*Primary Examiner*—Alexander Grosz

[57] ABSTRACT

A body supporting device comprises a first plastic section having oppositely disposed inner and outer surfaces. The outer surface is disposed above the inner surface and permanently defines a plurality of closely spaced regions of like size and contour which are interconnected by channels disposed below the regions. The inner surface of the first section permanently defines a like plurality of deep recesses. Each deep recess constitutes the inside of a corresponding region. The deep recesses are interconnected by shallow recesses. Each shallow recess constitutes the inside of a corresponding channel. The device further comprises a second plastic section sealed to the inner surface of the first section in a manner at which the deep and shallow recesses communicate with each other. A flexible hollow tube is diposed about the periphery of the sections and is secured thereto. The tube interior is connected via openings in the tube to the shallow recesses. The tube and sections are sealed to each other to prevent air and water leakage between the interior of the tube and sections and the outside thereof.

5 Claims, 7 Drawing Figures

FLUID FILLED BODY SUPPORTING DEVICE

BACKGROUND OF THE INVENTION

Bedridden patients who have to maintain a substantially motionless position for prolonged periods of time develop bedsores on the skin. These sores, referred to in medical terms as Decubitus Ulcers, are painful, hard to heal, and create conditions for further infection. Ulcer formations of this type are produced in most cases because the pressure exerted upon the skin surfaces under the body prominences of the patient which bear most of the weight of the patient when the body of the patient presses against the ordinary mattress or other body support, thereby obstructing the circulation of blood in the capillaries directly under these surfaces.

It is known that large, very deep water filled containers (waterbeds) of large size and weight permit the patient to float freely in such a manner that the pressures exerted upon the surface of the patient's body are distributed uniformly over the entire body, thus eliminating regions of high pressure under the bony prominences whereby the ulcers do not form. These large waterbeds are covered with a top plastic sheet free of tension. The patient, placed upon this sheet, does not get wet but effectively floats deep in water. However, waterbeds of such depth are much too large and too costly for general use.

When the depth and the size of the waterbed are both reduced to more convenient and smaller dimensions, as is done with the light weight water flotation mattresses, the upper surface of the mattress upon which the body is placed is subjected to a tension or shearing force which produces undue pressure against the skin, in particular under the bony prominences. The patient does not float in the same manner as in a waterbed because the body is supported by a combination of buoyancy force and the stress forces in the upper plastic sheet supporting the body. In the ideal situation using a water bed, the downwardly directed weight of the patient's body at any point along the body is counterbalanced by a force directed vertically upward by the buoyancy forces of water alone. The plastic sheet in such a case under the body of the patient and above the water is free to adjust to the contour of the patient causing no pressure whatsoever. Such an arrangement provides the best conditions for prevention of bedsores. However, when the sheet is not free to adjust, as in the case of a small light weight water mattress, the body supporting area is reduced, the depth is decreased, and most of the counterbalancing, body supporting force is derived from the tension in the top sheet of the mattress. As the surface is depressed in accordance with the body contour and weight of the patient, unequal forces are transmitted via the surface tension of the mattress. As a result regions of higher pressure are created, mainly under the body prominences which press against the underlying capillaries, and blood circulation can be obstructed as previously described.

Another type of small size mattress has been developed to deal with the problems of bedsores formation. This type of mattress is adapted to be filled with air. The whole surface of the mattress is divided in small chambers, or regions, tied together in two side by side groups. When one of the groups is inflated, the other is deflated, providing at all times an area for the body that is not resting on the mattress, but is completely relieved from pressure. Adjacent cells are alternatively inflated and deflated producing a massaging action.

Such air mattresses are not as effective as water filled mattresses in inhibiting ulcer formation.

This inferior performance is inherent in the geometry because the air pressure in the inflated region is twice as high as it would be if the entire mattress were to be completely inflated. The massaging action ameliorates but does not fully eliminate the adverse effects of localized high pressures.

The present invention is directed toward a new type of body support mattress that can be used with water or air alike. It is small in size, relatively light weight and, when air filled, can operate with considerably less air pressure than conventional air filled massaging mattresses, and yet provide excellent minimal support pressure. When filled with water, it is characterized by greatly reduced shearing stress, as compared to presently used light weight water flotation mattresses.

SUMMARY OF THE INVENTION

In accordance with the principles of the invention, a body supporting device employs a first plastic section having oppositely disposed inner and outer surfaces. The outer surface is disposed above the inner surface and permanently defines a plurality of closely spaced raised regions of like size and contour which are interconnected by channels disposed below the regions. The inner surface of the first section permanently defines a like plurality of deep recesses, each deep recess constituting the inside of a corresponding region. The deep recesses are interconnected by shallow recesses, each shallow recess constituting the inside of a corresponding channel.

A second plastic section is sealed to the inner surface of the first section in a manner in which said deep and shallow recesses communicate with each other. A flexible hollow tube is disposed around the periphery of said sections and is secured thereto. The tube has an outer wall with openings which connect the tube interior to said shallow recesses. The tube and sections are sealed to each other in a leak-proof manner to prevent leakage of air or water between the interior of the tube and sections and the outside thereof.

This combination of tubes and sections thus has a hollow interior with deep and shallow recesses and tube interior being interconnected. In use, the interior is completely filled with water or air.

When a patient sits upon the device, as, for example, when the patient is on a wheel chair, or when the patient lies upon the device of larger size when it is used as a mattress, the various raised regions conform to the body contour and, because of the intercommunicating hollow regions, the shallow channels and tube distribute the water or air as required. As the patient shifts in bodily position, the water or air movement adjusts the shape of the device accordingly.

The raised regions are depressed when conforming to the body contour and spread sideways to close the gaps therebetween, thus providing a continuous support between the spread regions and the body of the patient. Unlike the prior art devices, the top portions of the raised regions are not subjected to appreciable shearing forces since the tube substantially eliminates sideways deformation of the raised regions which would otherwise produce such forces with the resultant adverse effects previously described. The use of the tube filled with water or air permits the raised regions that are not underneath the body to remain upright whereby the surface stretch in the rest of the raised regions under the body (shearing force) is minimized, and the pressure on the skin is also minimized, thus minimizing ulcer formation.

DETAILED DESCRIPTION OF PREFERRED EMBODIMENTS

Figure 1:
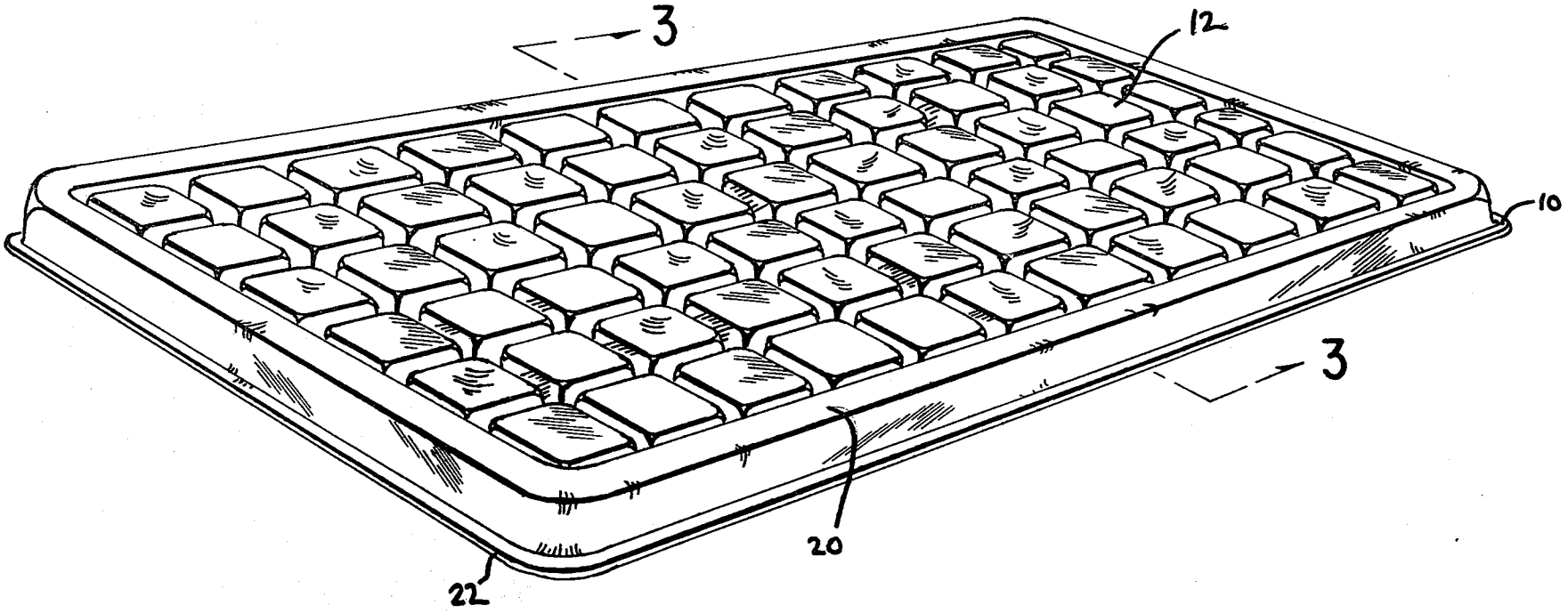
FIG. 1 is a top perspective view of one embodiment of the invention.
Figure 2:
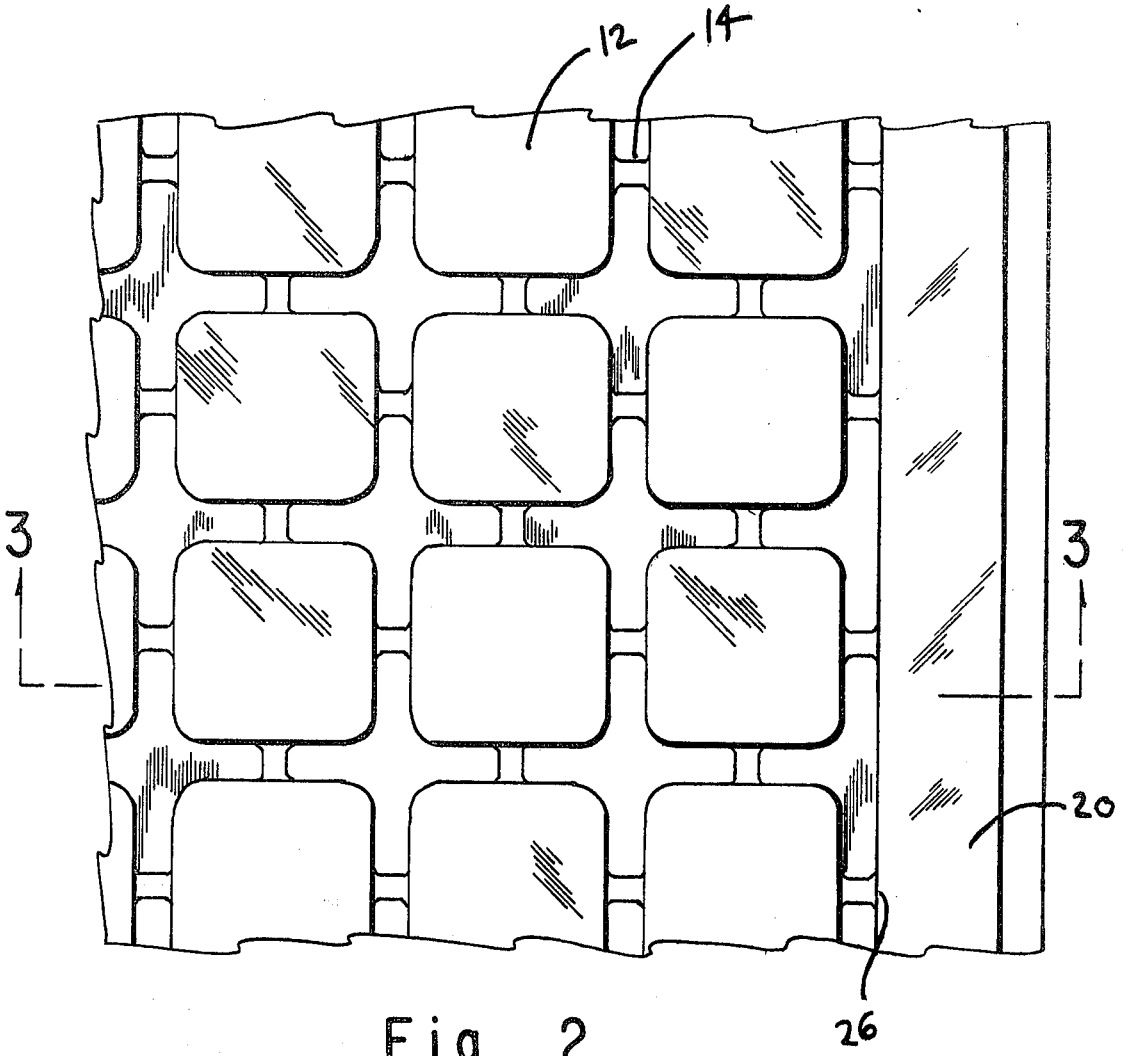
FIG. 2 is an enlarged top detail view thereof.
Figure 3:
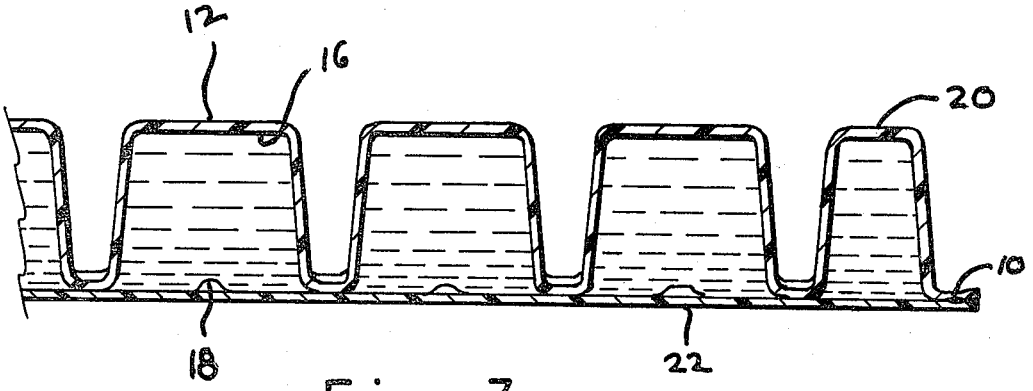
FIG. 3 is a cross section taken along line 3—3 in FIG. 1.
Figure 4:
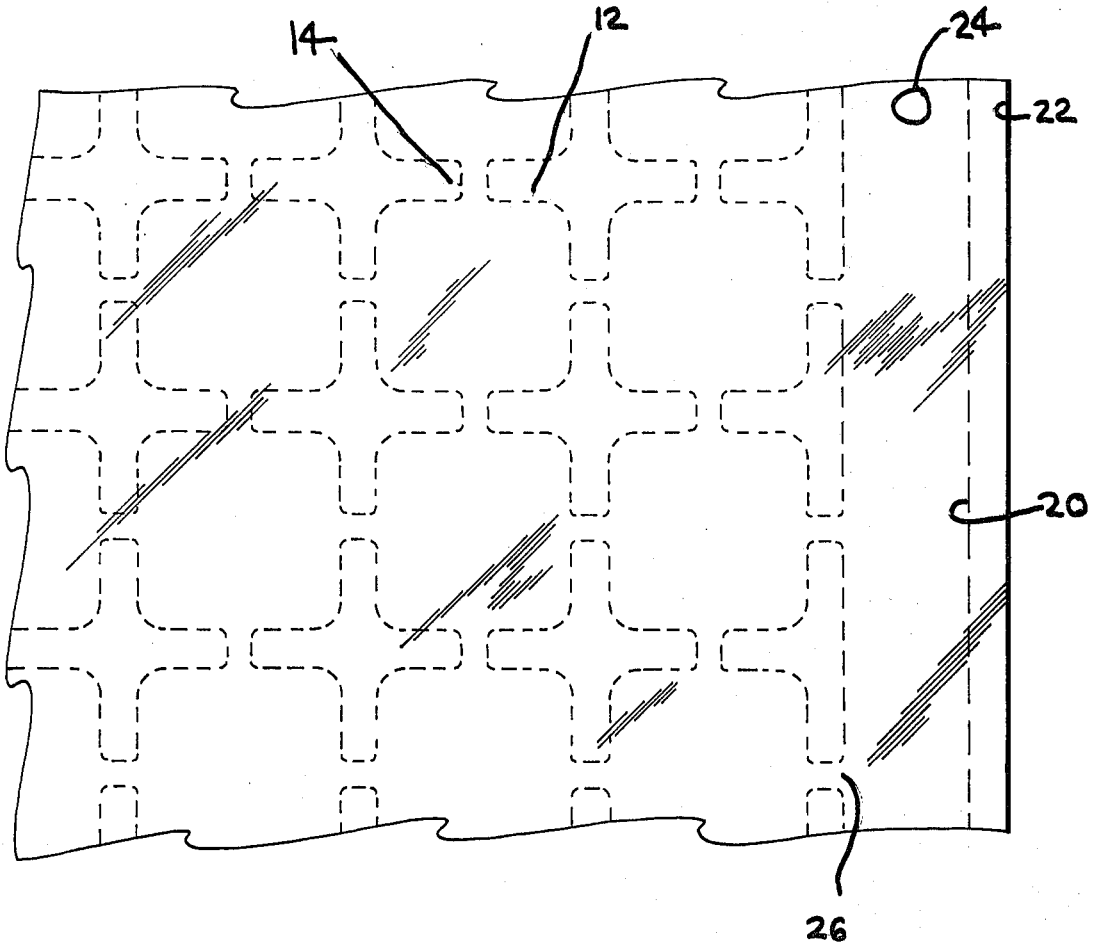
FIG. 4 is a bottom view thereof.

Referring now to FIGS. 1–4, a body supporting device has a first upper plastic section identified generally at 10 having oppositely disposed inner and outer surfaces. The outer surface extends above the inner surface and permanently defines a plurality of closely spaced like raised regions 12 which in top view define squares and in side cross section define rectangles.

Regions 12 are interconnected by small rectangular channels 14 which are disposed below the top of the regions but are disposed above the top portion of section 10 which is free of regions and channels. Each channel connects the midpoint of one side of one region to the midpoint of an adjacent side of an adjacent region.

The inner surface of section 10 defines a plurality of deep recesses 16 each of which is the inside of a corresponding region. These deep recesses are interconnected by shallow recesses 18, each of which is the inside of a corresponding channel.

A flexible hollow tube 20 generally oval in cross section is disposed around the periphery of section 10 and is integral therewith. Channels 14 connect the outermost regions 12 to openings 26 on the side of the tube so that recesses 16 and 18 are connected to each other and to the interior of the tube. A flat second plastic section 22 seals off the bottom of section 10.

Sections 10 and 22 and tube 10 are sealed together in an air tight and water tight manner so as to prevent air and water leakage between the interior of the sections and tube and the outside thereof.

Section 20 carries a sealable port 24 which permits water to enter for filling or to be discharged for emptying the body supporting device. The device can then be used as previously described.

Section 10 can be produced by conventional vacuum forming techniques.

Figure 5:
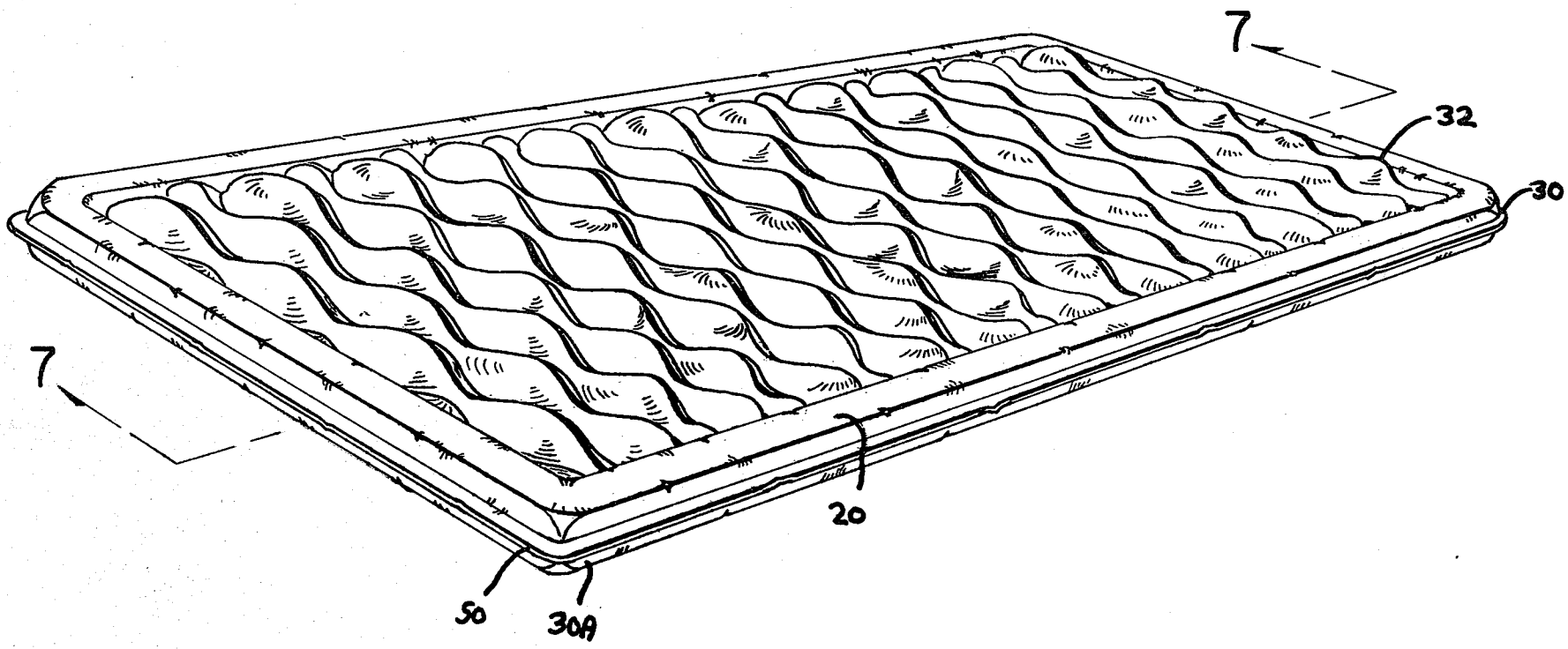
FIG. 5 is a top perspective view of another embodiment of the invention.
Figure 6:
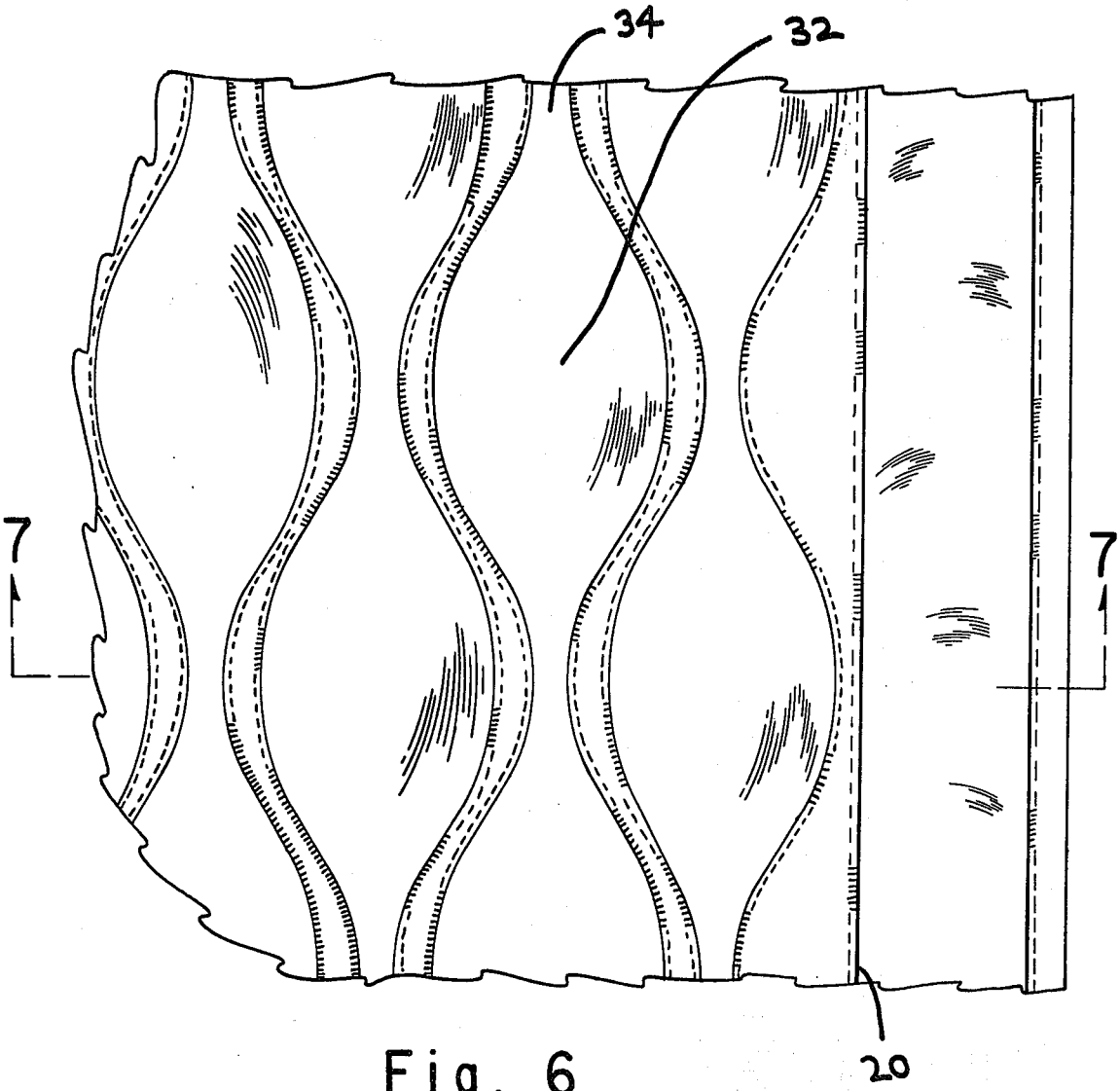
FIG. 6 is an enlarged top detail view of the embodiment of FIG. 5.
Figure 7:
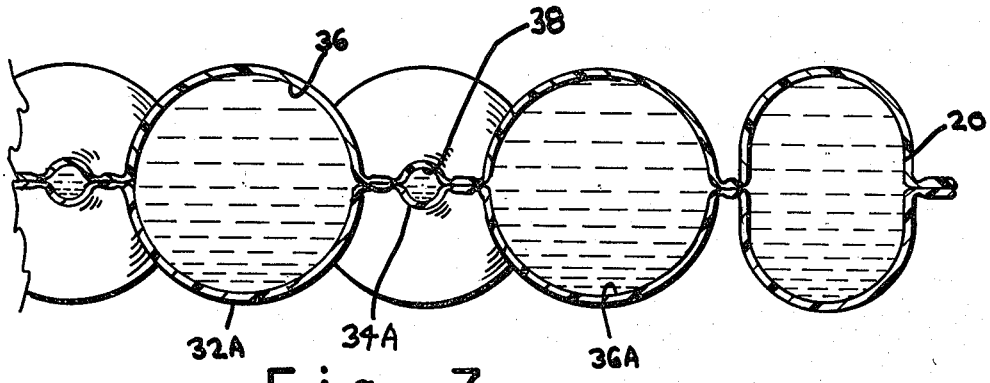
FIG. 7 is a cross section taken along line 7—7 in FIG. 5.

Referring now to FIGS. 5–7, a body supporting device has a first upper plastic section identified generally at 30 having oppositely disposed inner and outer surfaces. The outer surface extends above the inner surface and permanently defines a plurality of closely spaced like enlarged regions 32. These regions as viewed from the top have a shape resembling a football and in cross section have a shape resembling the upper half of a sphere. Other shapes can be used as desired. The regions are interconnected by much smaller raised portions or channels 34 which is viewed from the top resemble elongated cylinders of small diameter. The inner surface of this upper section permanently defines a like plurality of recesses 36, each recess constituting the inside of a corresponding region. The inner surface of each channel 34 defines an elongated shallow recess 38.

A second like section 30A inverted in position with respect to the first section has an outer surface which extends below the inner surface and permanently defines like regions 32A. These regions are interconnected by like channels 34A. The inner surface of this lower section defines a like plurality of like recesses 36A, each recess constituting the inside of a corresponding region. The inner surface of each channel 34A defines an elongated shallow recess 38A.

Each section 30 and 30A can be produced by vacuum forming techniques.

The sections are interconnected with their peripheries abutting and sealed to each other at 50.

The sections can have one or more sealable ports for water fill and removal as previously described.

As previously described, hollow flexible tube 20 is disposed around the peripheries of both sections and is integral therewith. The hollow interior of tube 20 is connected to the interior recesses whereby the tube functions as previously described.

What is claimed is:

1. A body supporting device comprising:

a first plastic section having oppositely disposed inner and outer surfaces, the outer surface being disposed above the inner surface and permanently defining a plurality of closely spaced raised regions of like size and contour which are interconnected by channels disposed below the regions, the inner surface permanently defining a like plurality of deep recesses, each deep recess constituting the inside of a corresponding region, said deep recesses being interconnected by shallow recesses, each shallow recess constituting the inside of a corresponding channel;

a second plastic section sealed to the inner surface of the first section in a manner in which said deep and shallow recesses communicate with each other; and a flexible hollow tube disposed around the periphery of said sections and secured thereto, said tube having a wall with openings which connect the tube interior to said shallow recesses, said tube and sections being sealed to each other to prevent air and water leakage between the interior of the tube and sections and the outside thereof.

2. The device of claim 1 including a sealable port in said second section whereby water can be introduced into and expelled from said recesses and tube interior.

3. The device of claim 1 wherein said section section is essentially flat.

4. The device of claim 1 wherein the second section is identical to the first section but is inverted in position with respect thereto.

5. The device of claim 1 wherein said sections have a rectangular periphery and said regions are rectangular in shape.

* * * * *